US006889745B2

(12) United States Patent
Redemske

(10) Patent No.: US 6,889,745 B2
(45) Date of Patent: May 10, 2005

(54) METHOD OF HEATING CASTING MOLD

(75) Inventor: John A. Redemske, Milford, NH (US)

(73) Assignee: Metal Casting Technology, Incorporated, Milford, NH (US)

( * ) Notice: Subject to any disclaimer, the term of this patent is extended or adjusted under 35 U.S.C. 154(b) by 68 days.

(21) Appl. No.: 10/241,819

(22) Filed: Sep. 10, 2002

(65) Prior Publication Data

US 2004/0045692 A1 Mar. 11, 2004

(51) Int. Cl.[7] ..... B22C 9/12
(52) U.S. Cl. ..... 164/121; 164/12
(58) Field of Search ..... 164/20, 21, 12, 164/121, 164, 165, 166

(56) References Cited

U.S. PATENT DOCUMENTS

| | | | | | |
|---|---|---|---|---|---|
| 2,771,648 | A | * | 11/1956 | Valyl | 164/12 |
| 3,259,949 | A | | 7/1966 | Moore | 22/196 |
| 4,047,882 | A | * | 9/1977 | Morita | 432/9 |
| 4,232,726 | A | * | 11/1980 | Michelson | 164/12 |
| 4,291,739 | A | | 9/1981 | Baur | 164/5 |
| 4,638,845 | A | * | 1/1987 | Sato et al. | 164/12 |
| 4,854,368 | A | | 8/1989 | Vezirian | 164/34 |
| 4,874,029 | A | | 10/1989 | Chandley | 164/34 |
| 5,069,271 | A | | 12/1991 | Chandley et al. | 164/516 |
| 5,746,272 | A | | 5/1998 | Mastrorio et al. | 164/516 |
| 5,906,234 | A | | 5/1999 | Mastrorio et al. | 164/45 |
| 5,909,765 | A | | 6/1999 | McDowell | 164/516 |
| 5,927,379 | A | | 7/1999 | Yasrebi et al. | 164/518 |
| 5,996,682 | A | | 12/1999 | Cai et al. | 164/516 |
| 6,019,927 | A | | 2/2000 | Galliger | 264/221 |
| 6,116,327 | A | | 9/2000 | Beighton | 164/45 |
| 6,129,138 | A | | 10/2000 | Gartland | 164/516 |

* cited by examiner

*Primary Examiner*—Kiley Stoner
*Assistant Examiner*—Len Tran

(57) ABSTRACT

A thermally efficient method for the heating a gas permeable wall of a bonded refractory mold wherein the mold wall defines a mold cavity in which molten metal or alloy is cast. The mold wall is heated by the transfer of heat from hot gas flowing inside of the mold cavity to the mold wall. Hot gas is flowed from a hot gas source outside the mold through the mold cavity and gas permeable mold wall to a lower pressure region exterior of the mold to control temperature of an interior surface of the mold wall.

15 Claims, 7 Drawing Sheets

METHOD OF HEATING CASTING MOLD

FIELD OF THE INVENTION

This invention relates to a method of heating a gas permeable refractory mold and regulating the temperature of the mold in preparation for the casting of molten metallic material into the mold.

BACKGROUND OF THE INVENTION

The investment casting process typically uses a refractory mold that is constructed by the buildup of successive layers of ceramic particles bonded with an inorganic binder around an expendable pattern material such as wax, plastic and the like. The finished refractory mold is usually formed as a shell mold around a fugitive (expendable) pattern. The refractory shell mold is made thick and strong enough to withstand: 1) the stresses of steam autoclave or flash fire pattern elimination, 2) the passage through a burnout oven, 3) the withstanding of thermal and metallostatic pressures during the casting of molten metal, and 4) the physical handling involved between these processing steps. Building a shell mold of this strength usually requires at least 5 coats of refractory slurry and refractory stucco resulting in a mold wall typically 4 to 10 mm thick thus requiring a substantial amount of refractory material. The layers also require a long time for the binders to dry and harden thus resulting in a slow process with considerable work in process inventory.

The bonded refractory shell molds are typically loaded into a batch or continuous oven heated by combustion of gas or oil and heated to a temperature of 1600° F. to 2000° F. The refractory shell molds are heated by radiation and conduction to the outside surface of the shell mold. Typically less than 5% of the heat generated by the oven is absorbed by the refractory mold and greater than 95% of the heat generated by the oven is wasted by passage out through the oven exhaust system.

The heated refractory molds are removed from the oven and molten metal or alloy is cast into them. An elevated mold temperature at time of cast is desirable for the casting of high melting temperature alloys such as ferrous alloys to prevent misruns, gas entrapment, hot tear and shrinkage defects.

The trend in investment casting is to make the refractory shell mold as thin as possible to reduce the cost of the mold as described above. The use of thin shell molds has required the use of support media to prevent mold failure as described by Chandley et. al. U.S. Pat. No. 5,069,271. The '271 patent discloses the use of bonded ceramic shell molds made as thin as possible such as less than 0.12 inch in thickness. Unbonded support particulate media is compacted around the thin hot refractory shell mold after it is removed from the preheating oven. The unbonded support media acts to resist the stresses applied to the shell mold during casting so as to prevent mold failure.

Thin shell molds however, cool off more quickly than thicker molds following removal from the mold preheat oven and after surrounding with support media. This fast cooling leads to lower mold temperatures at the time of casting. Low mold temperatures can contribute to defects such as misruns, shrinkage, entrapped gas and hot tears, especially in thin castings.

SUMMARY OF THE INVENTION

An embodiment of the present invention provides a thermally efficient method for the heating a gas permeable wall of a refractory mold defining a mold cavity, in which molten metal or alloy is cast, by the transfer of heat from hot gas flowing inside of the mold cavity to the mold wall.

Another embodiment of the invention provides a method where an interior surface of the gas permeable mold wall is heated and maintained at a desired casting temperature until the time of filling the mold cavity with molten metal or alloy and without heating the bulk of a particulate support media which optionally may be disposed about the mold.

The invention involves, in one embodiments the heating of a gas permeable mold wall of a bonded refractory mold by the flow of hot gas from a hot gas source through one or more refractory conduit(s) into a mold cavity and through the gas permeable wall to a region exterior of the mold. The flow of gas is effected by directing gas into the mold cavity inside of the mold at a pressure that exceeds the pressure present at the mold exterior so as to establish a differential pressure across the shell mold wall which forces the hot gas to flow in a substantially uniform manner through all areas of the mold wall.

A gas permeable bonded refractory shell mold used in practice of an embodiment of the invention can be as thick as about 10 mm or as thin as about 1 mm, although the invention is not limited to this range of shell mold wall thicknesses. The mold may be surrounded with an optional unbonded refractory particulate support media as needed to maintain the structural integrity of the mold during the mold wall heating and casting operations. The resulting empty mold cavity can be cast by counter-gravity, gravity or pressure pouring methods.

The heat transfer from the hot gases to the mold wall is extremely efficient as the hot gas passes through the permeable shell mold wall and also the surrounding particulate support media if it is used. When the particulate support media is used, almost all of the useful heat contained in the hot gas is transferred to the mold and unbonded support media. In this case, ambient temperature gas exits the support media. A favorable temperature gradient is also established in the unbonded support media, if used surrounding the bonded refractory mold. This thermal gradient aids in maintaining the surface temperature of the mold wall defining the mold cavity during the brief period between when the hot gas flow is removed and mold filling begins.

DESCRIPTION OF THE INVENTION

The present invention involves the heating of gas permeable wall of a refractory mold by the flow of hot gas from a hot gas source through one or more refractory conduit(s) into the mold cavity and through the gas permeable wall of the mold cavity to a space or region exterior of the mold. This flow of gas is caused by the creation of a pressure higher in the mold cavity than the pressure present at the region located exterior of the mold wall.

Figure 1:
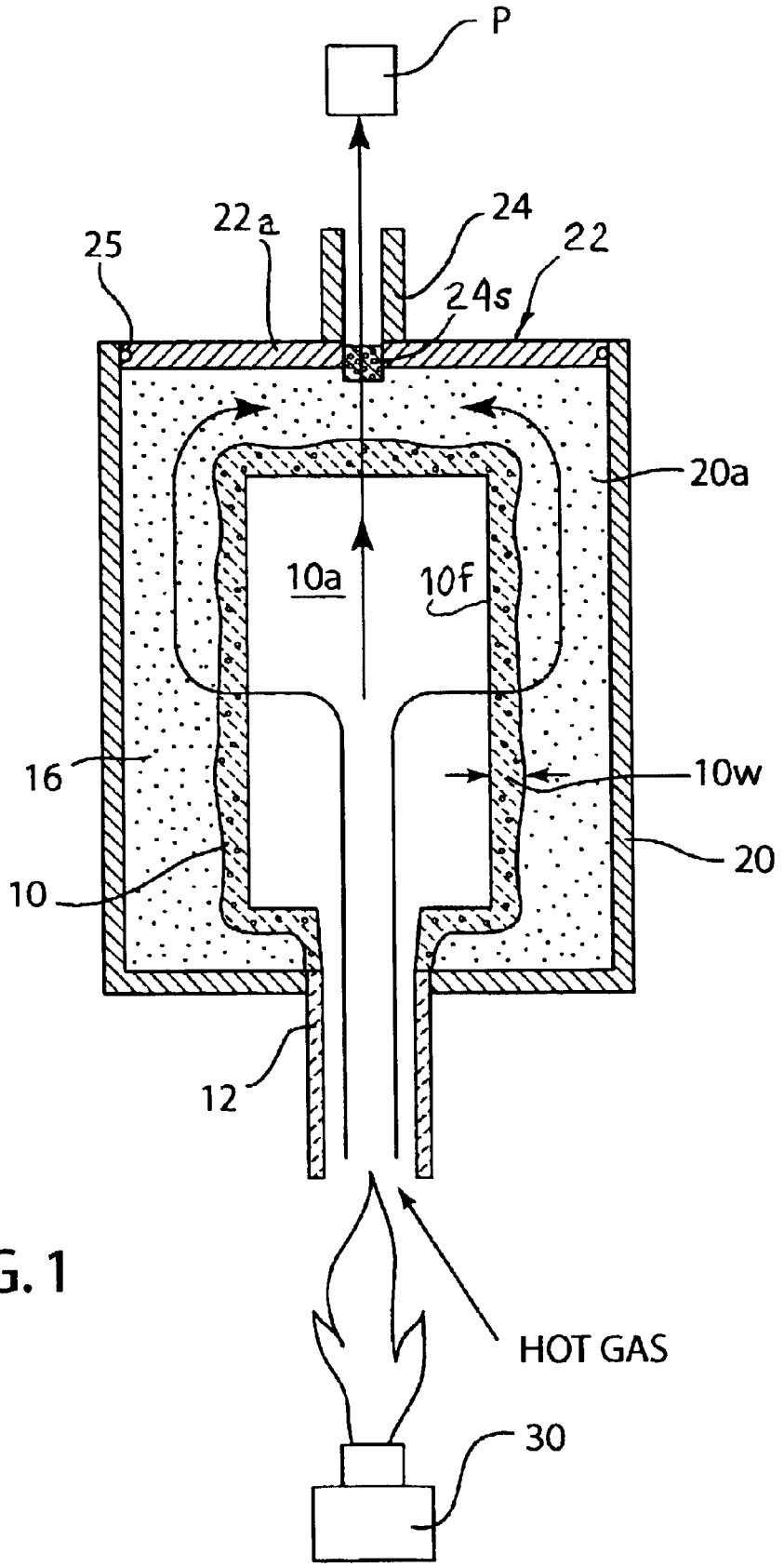
FIG. 1 is a cross-sectional view of apparatus for practicing an embodiment of the invention.
Figure 1A:
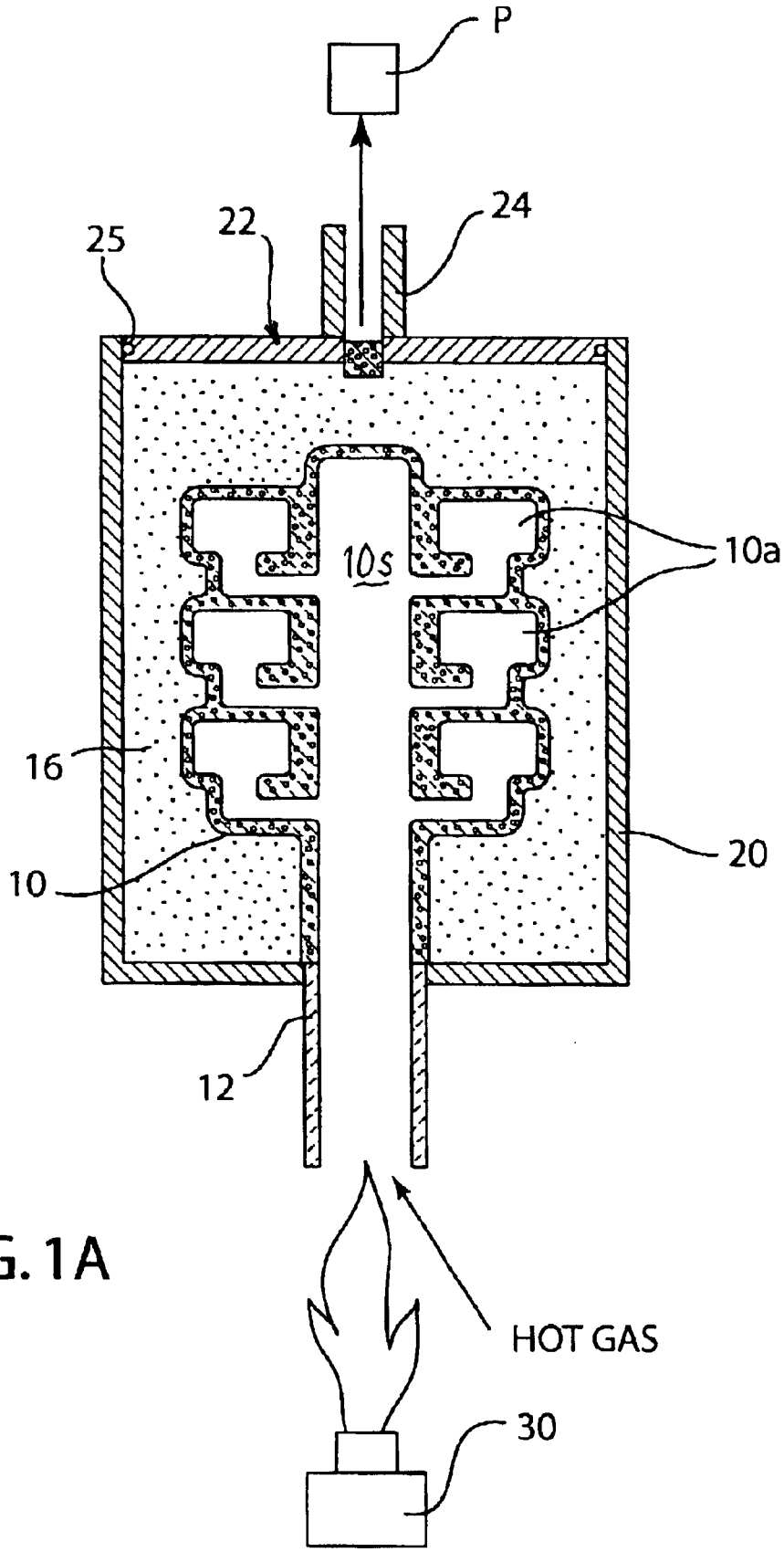
FIG. 1A is similar to FIG. 1 but shows a shell mold with a plurality of mold cavities embedded in the particulate support media with a refractory conduit attached at a bottom location for countergravity casting.
Figure 1B:
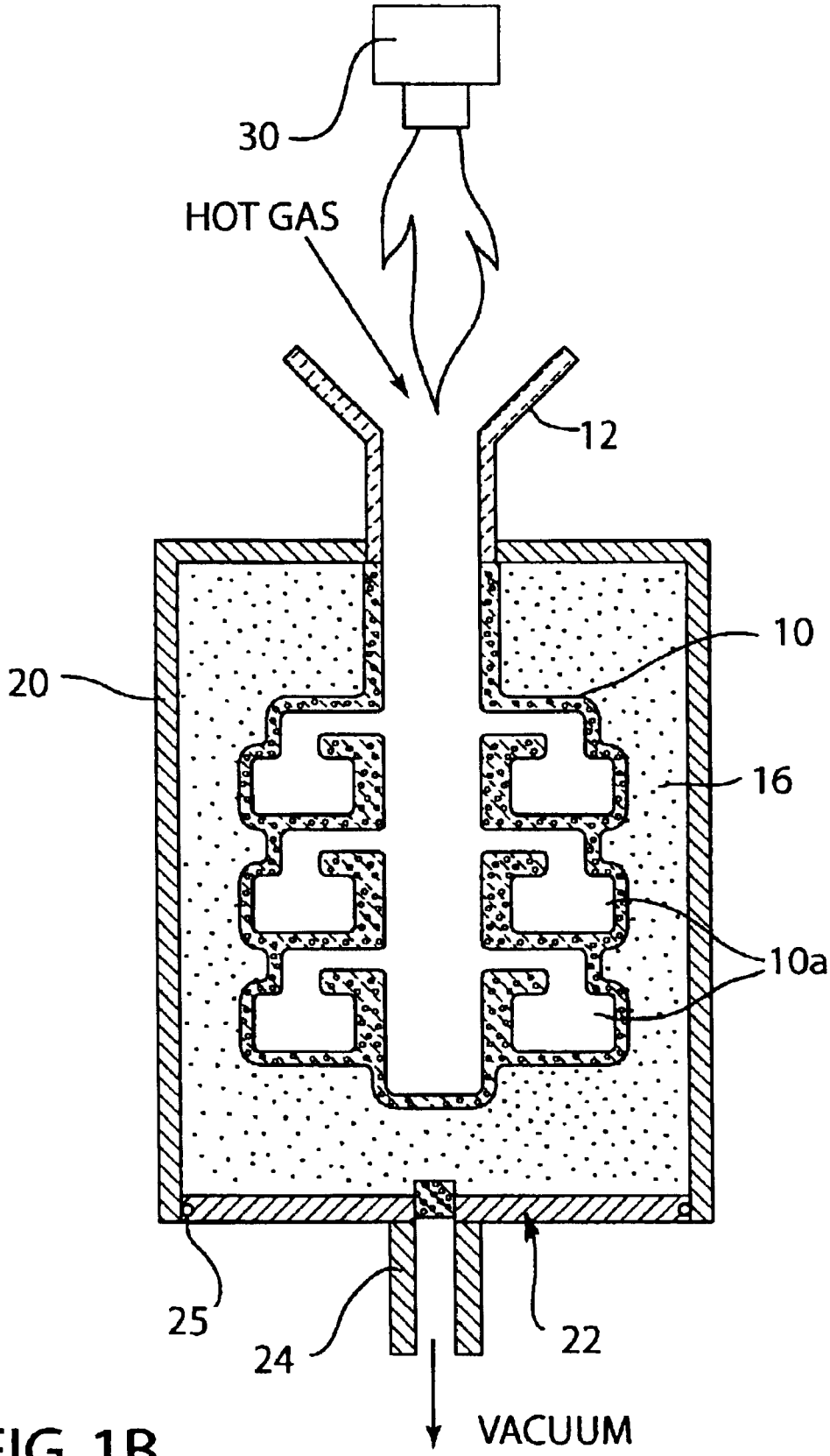
FIG. 1B is similar to FIG. 1 but shows a shell mold with a plurality of mold cavities embedded in the particulate support media with a refractory conduit attached at a top location for gravity casting.

An embodiment of the invention offered for purposes of illustration and not limitation involves a bonded gas permeable refractory shell mold 10, FIG. 1, that can be made by methods well known in the investment casting industry, such as the well known lost wax investment mold-making process. For example, a fugitive (expendable) pattern assembly typically made of wax, plastic foam or other expendable pattern material is provided and includes one or more patterns having the shape of the article to be cast. The pattern(s) is/are connected to expendable sprues and gates to form the complete pattern assembly. The pattern assembly is repeatedly dipped in ceramic/inorganic binder slurry, drained of excess ceramic slurry, stuccoed with refractory or ceramic particles (stucco), and dried in air or under controlled drying conditions to build up a bonded refractory shell mold on the pattern. After a desired shell mold thickness is built up on the pattern, the pattern is selectively removed by well known pattern removal techniques, steam autoclave or flash fire pattern elimination, leaving a green shell mold having one or more mold cavities 10*a* (one shown) for filling with molten metal or alloy and solidification therein to form a cast article having the shape of the mold cavity 10*a*. Alternatively, the pattern can be left inside the bonded refractory mold and removed later during mold heating. The pattern assembly may include one or more preformed refractory conduits 12 (one shown) attached to it for incorporation as part of the shell mold 10. The refractory conduit 12 is provided for flow of hot gases during mold preheating pursuant to the invention as well as for conducting molten metal or alloy into the mold cavity 10*a*. In lieu of being attached to the pattern assembly, the conduit 12 can be attached to the shell mold 10 after it is formed, or during assembly of the shell mold 10 in a casting chamber 20*a* of metal housing or can 20, FIG. 2. For countergravity casting, the refractory conduit 12 typically has the shape of a long ceramic tube disposed at the bottom of the mold 10 to be immersed into a pool of molten metal or alloy, FIG. 2, and supply molten metal or alloy to the mold cavity 10*a*. The shell mold 10 can include a plurality of mold cavities 10*a* disposed about and along a length of a central sprue 10*s* as illustrated, for example, in FIG. 1A where like reference numerals are used to designate like features. Similarly, for gravity casting, FIG. 1B, the shell mold 10 can include one or more mold cavities 10*a*. Multiple mold cavities 10*a* are illustrated, for example, in FIG. 1B. For gravity casting, the refractory conduit 12 is disposed on the top of the assembly of the shell mold 10, particulate support media 16, and can 20 and typically has a funnel shape to receive molten metal or alloy from a pour vessel, such as a conventional crucible (not shown).

The permeability of the bonded refractory shell mold wall 10*w* is chosen to cause a gas flow rate through the mold wall suitable to transfer heat into the mold wall at a rate to control temperature of an interior surface 10*f* of the mold wall. The heating rate of the mold wall 10*w* is proportional to the gas flow rate through the mold wall 10*w*. A gas flow rate of up to 100 scfm (standard cubic feet per minute) has been typically used for the sizes of molds tested in the Examples below. Larger molds and faster heating rates will require higher hot gas flow rates. The hot gas flow rate through the bonded refractory mold wall 10*w* is controlled by the particle shape and size distribution of the refractory flours employed in making the mold, the void fraction in the dried shell layers or coatings, the binder content and the thickness of the mold wall 10*w*. The thickness of the bonded refractory mold wall 10*w* has ranged between 1.0 mm and 10 mm depending upon the size of the mold. The use of a bonded refractory mold wall low having lower gas permeability than the space or region R exterior of the bonded mold 10 causes a differential pressure of typically at least 0.3 atmospheres across the mold wall low in practice of an illustrative embodiment of the invention. The region R typically contains unbonded particulate support medium 16 (e.g. unbonded dry foundry sand) in one embodiment of the invention as described in Chandley et. al. U.S. Pat. No. 5,069,271, which is incorporated herein by reference. This pressure differential forces the hot gas to flow in a substantially uniform manner through all areas of the mold wall 10*w* in practice of the invention. The region R located about the shell mold 10 can be empty in another embodiment of the invention as described in Chandley et. al. U.S. Pat. No. 5,042,561, which is incorporated herein by reference, when the mold 10 has sufficient strength to withstand casting stresses and thus does not need to be externally unsupported in the casting chamber 20*a* during casting.

The type of refractory chosen for the shell mold 10 should be compatible with the metal or alloy being cast. If particulate support media 16 is provided about the shell mold 10, the coefficient of thermal expansion of the shell mold should be similar to that of the support media to prevent differential thermal expansion cracking of the bonded refractory mold. In addition, for larger parts, a refractory with low coefficient of thermal expansion, such as fused silica, should be used for the bonded refractory shell mold 10 and support media 16 to prevent thermal expansion buckling of the mold cavity wall low.

The bonded refractory shell mold 10 is placed in the casting chamber 20*a* of can 20 with the refractory conduit(s) 12 extending outside of the can 20, FIG. 1. Refractory mold 10 then is surrounded with compacted un-bonded refractory particulate support media 16. After the support media has covered the bonded refractory shell mold and has filled the casting chamber 20*a* the upper end of the can 20 is closed off using a closure 22, such as a moveable top cover 22*a* or a diaphragm (not shown), to exert a compressive force on the particulate support media 16 so that the support media remains firmly compacted. A screened port 24, which along with an o-ring seal 25 is usually part of the top cover 22*a*, is provided to enable the flow of gas out of the chamber 20*a* while screen 24*s* thereof retains the particulate support media 16 therein. Chandley et. al. U.S. Pat. No. 5,069,271 describes use of particulate support media about a thin shell mold and is incorporated herein by reference.

Pursuant to an embodiment of the invention, the can 20 is moved to a hot gas source 30 and lowered to position the refractory conduit 12 into the hot gas flow, FIG. 1, such that the hot gas flows through the conduit 12 into the mold cavity 10*a*. The gas can be heated by any means such as electrically heated or preferably by gas combustion. The temperature of the hot gas can vary between 427° C. (800° F.) and 1204° C. (2200° F.) depending upon the metal or alloy to be cast and the desired amount of mold heating.

The hot gas is caused to flow through conduit 12 into the mold cavity 10*a* and through the gas permeable bonded refractory mold wall 10*w* by creating a differential pressure effective to this end between the mold cavity 10*a* and the region occupied by the particulate support media 16 in chamber can 20. For purposes of illustration and not limitation, typically at least 0.3 atmospheres pressure differential is imposed across the mold wall low. In accordance with an embodiment of the invention, this differential pressure can be established by applying a sub-atmospheric pressure (vacuum) to the screened chamber port 24 that in turn communicates the vacuum to the unbonded particulate support media 16 disposed about the bonded refractory shell mold 10 in can 20. Use of subambient pressure at port 24 enables the hot gas being delivered to the refractory conduit 12 and the mold interior (mold cavity 10*a*) to be at atmospheric pressure. A higher vacuum can be applied at port 24 to increase the flow rate of hot gas that is flowed through the mold cavity 10*a* and mold wall 10*w*. Alternately, hot gas flow into the shell mold 10 and through the mold cavity 10*a* and gas permeable mold wall 10*w* can be effected by applying a pressure of the hot gas higher than atmospheric at the conduit 12 and, thereby, the mold interior, while maintaining the exterior of the shell mold 10 (e.g. particulate support media 16 in can 20) at a pressure close to ambient. For example, a superambient pressure (e.g. 15 psi) of the hot gas can be provided to conduit 12 using a high pressure burner available from North American Mfg. Co. This embodiment can force a higher mass of hot gas through the shell mold 10, thereby resulting in shorter mold heating times. A combination of both of the above-described vacuum and pressure approaches can also be used in practice of the invention.

Figure 2:
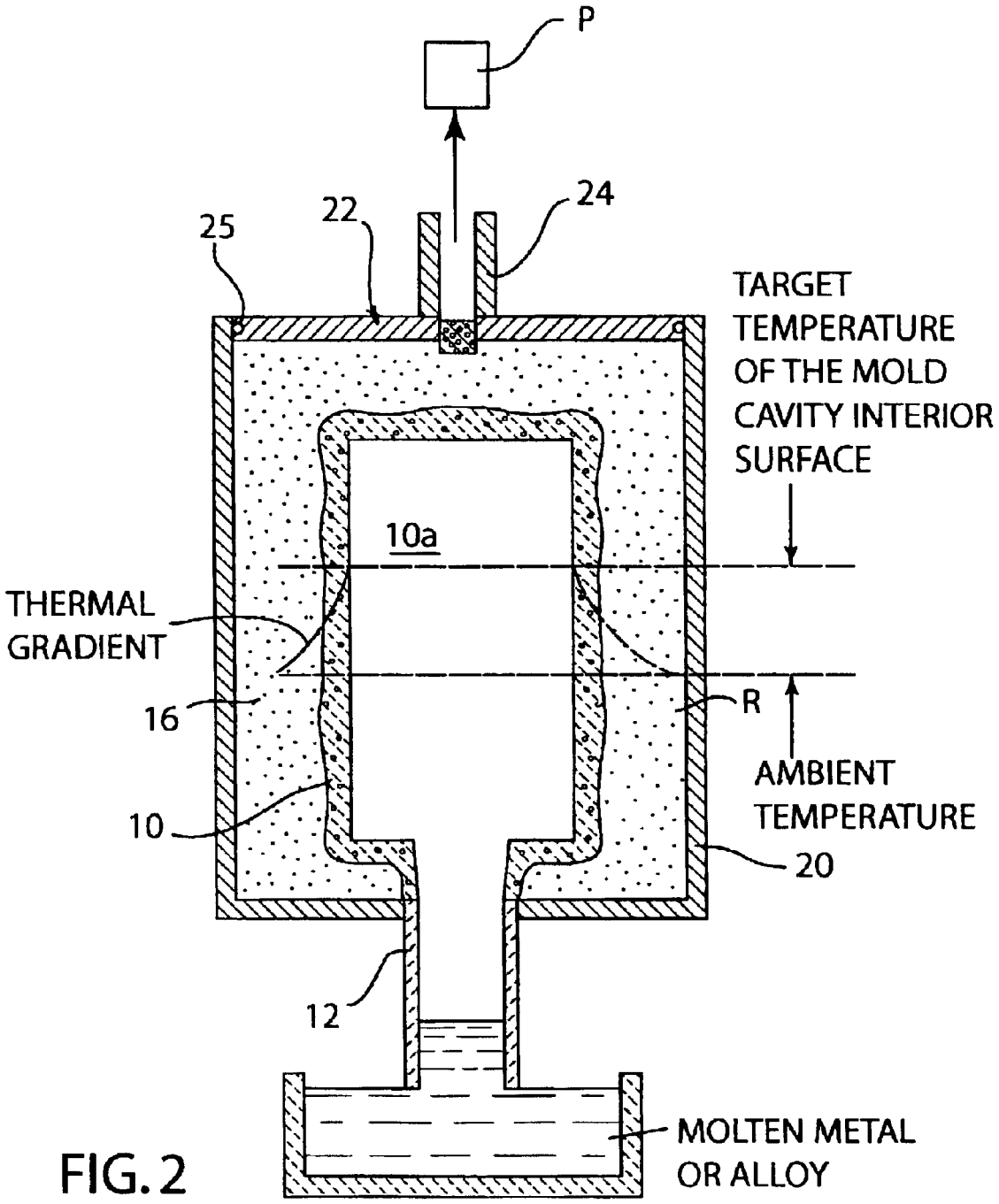
FIG. 2 is similar to FIG. 1 and shows the thermal gradient developed across the shell mold wall and a small distance in the particulate support media by an embodiment of the invention.

The mold wall 10*w* defining the mold cavity 10*a* is heated to the desired temperature for casting of molten metal or alloy in mold cavity 10*a* by the continued flow of hot gas through the permeable bonded refractory mold wall. The hot gas temperature, the heating time and the flow rate across the gas permeable bonded refractory mold wall 10*w* control the final temperature of the interior surface of mold wall 10*w*. After the mold has reached the desired temperature for casting, the flow of hot gas from source 30 is discontinued, and molten metal or alloy is cast into the heated mold cavity 10*a*. When unbonded particulate support media is disposed about the shell mold 10, the mold wall 10*w* as well as some distance into the unbonded support media 16 are heated during flow of the hot gas through the mold wall. A favorable temperature gradient, FIG. 2, is established in the particulate support media 16, which aids in the maintenance of the surface temperature of the mold cavity 10*a* between when the hot gas flow is discontinued and the mold is cast as illustrated, for example, in FIG. 3.

It should be noted that the energy efficiency of the mold cavity heating method pursuant to the invention is very high. When support media 16 is used, the bonded refractory shell mold 10 and the un-bonded support media 16 absorb almost all of the heat from the hot gas that enters the mold. This compares to less than 5% of the heat that is absorbed by a mold in mold heating furnaces typically used in investment casting. In the typical investment casting furnace, over 95% of the energy is wasted as the hot gases travel up the exhaust stack of the furnace.

If the fugitive pattern assembly was left inside the bonded refractory shell mold 10, it can be removed during such mold heating. The hot gas flow is initially directed at the pattern assembly, causing it to melt and vaporize, thereby leaving mold cavity 10*a* substantially free of the pattern material. The forcing of hot gas to flow through the bonded refractory mold wall 10*w* as described above pursuant to the invention causes this pattern removal to occur faster, especially in thin and long patterns.

The hot gas from source 30 can have strong oxidizing, neutral or reducing potential depending upon the desire to remove carbonaceous pattern residue from the mold cavity 10*a*. It should be noted that the ability to oxidize carbonaceous pattern residue is vastly enhanced by the forced flow of oxidizing gas through all areas of the mold cavities 10*a* and through the bonded refractory mold wall 10*w*. The oxidation of the pattern residue can also generate heat that can be used to increase the temperature of the bonded refractory mold 10.

For low melting temperature alloys such as aluminum and magnesium, if elevated temperatures were used to remove pattern residue, the temperature of the bonded refractory shell mold 10 can be reduced to cool the mold wall 10*w* to a temperature more suitable for casting the particular metal or alloy. Cooling gas from a cooling gas source (not shown) can replace the hot gas from source 30 while maintaining a suitable differential pressure across the mold wall 10*w* to this end. The pressure differential will cause a flow of cooler gas through the mold wall 10*w*, thereby reducing and controlling the temperature of the mold cavities 10*a* and mold wall 10*w*. The source of cooling gas can comprise ambient air or any other source of cooling gas.

Another embodiment of the invention involves a mold heating process to adjust the temperature of a previously heated shell mold 10 after it is placed in support media 16. In this embodiment, the bonded refractory mold 10 initially is heated in an oven (not shown) at a high enough temperature to remove the pattern residue. The hot bonded refractory mold 10 then is removed from the oven, placed in casting chamber 20*a* of can 20, and the particulate support media 16 is compacted around the mold 10. Such a mold 10 typically will have a reduced mold wall thickness and therefore require the application of the particulate support media 16 during casting to prevent mold failure. Such a thin shell mold, however, cool off more quickly than a thicker-wall shell molds following removal from the mold preheat oven and after surrounding with support media 16. This fast cooling leads to a lower mold temperature at the time of casting. Low mold wall temperatures can contribute to defects such as misruns, shrinkage, entrapped gas and hot tears, especially in thin castings.

The temperature of the mold wall 10*w* is increased back to the desired range by the flowing of the hot gas from hot gas source 30 through refractory conduit 12 into the mold cavity 10*a* and through the gas permeable mold wall 10*w* to region R. This flow of hot gas is caused by the creation of a pressure higher in the mold cavity 10*a* than the pressure exterior of the mold wall low as described above.

After the shell mold 10 has reached the desired temperature, the flow of hot gas is discontinued and molten metal is cast into the reheated mold cavity 10*a*.

EXAMPLES

The following Examples are offered to further illustrate and not limit the invention. The first Example 1 involves using an embodiment of the mold heating process of the invention to raise the temperature of the mold wall 10*w* of shell mold 10 formed pursuant to the above processing from ambient up to a desired casting temperature.

Patterns for an automotive rocker arm were molded in expanded polystyrene at a density of 5 Lb/ft$^3$. These patterns were assembled onto a 3" diameter×12" long cylindrical tube of expanded polystyrene using a hot melt adhesive. The bottom of the cylindrical expanded polystyrene tube was attached with hot melt glue to a refractory tubular conduit 12. This conduit was formed from clay bonded fused silica refractory.

The pattern assembly was coated with a refractory coating composed of fused silica bonded with colloidal silica. A thin 0.1 mm coating of fused silica of average particle size 40 microns was applied first and dried. This was followed with a thicker 1 mm coating of fused silica of average particle size 120 microns which was also dried. The gas permeability of the final dried coating resulted in a gas flow of 0.034 scfm per $in^2$ of pattern surface area per psi of pressure differential across the coating. The coatings formed a shell mold about the patterns.

The refractory-coated pattern assembly was placed in a 16" diameter metal (e.g. steel) casting chamber 20*a* of can 20 with the refractory conduit 12 extending outside the can through a hole in the bottom thereof. The refractory coated pattern assembly was surrounded with compacted unbonded refractory support media 16. A mullite grain, Accucast LD35 from Carbo Ceramics, was used as the support media 16 and compacted with vibration. After the support media completely filled the casting chamber, the can 20 was closed off with a top cover 22*a*. A seal 25 between the top cover 22*a* and the can formed a slip joint whereby the top cover could slide into the casting chamber to maintain firm contact with the support media 16. This assured that the support media remained firmly compacted. The top cover 22 also contained screened vacuum port 24 that enabled the flow of gas out of the chamber 20*a* but retained the support media therein.

The steel can 20 was moved to a small gas fired "Speedy Melt" furnace available from MIFCO, Danville, Ill., and capable of producing 325,000 BTU/hour and lowered to position the refractory conduit 12 into the hot gas stream discharged from the furnace. Vacuum at a level of about 20 in Hg was applied to the support media 16 inside the casting chamber of the steel can through the vacuum port 24 in the top cover 22*a*. A vacuum pump P was connected to port 24 to this end.

The temperature of the hot gas entering the refractory conduit 12 was controlled at about 1100° C. (2012° F.). The expanded polystyrene pattern material was removed from the rocker arm-shaped mold cavities by the application of the hot gas flow to the pattern material. The hot gas was also controlled to an oxygen content of 8 to 10% by weight, so as to have a strong oxidizing potential for the removal carbonaceous pattern residue from the rocker arm-shaped mold cavities.

Figure 3:
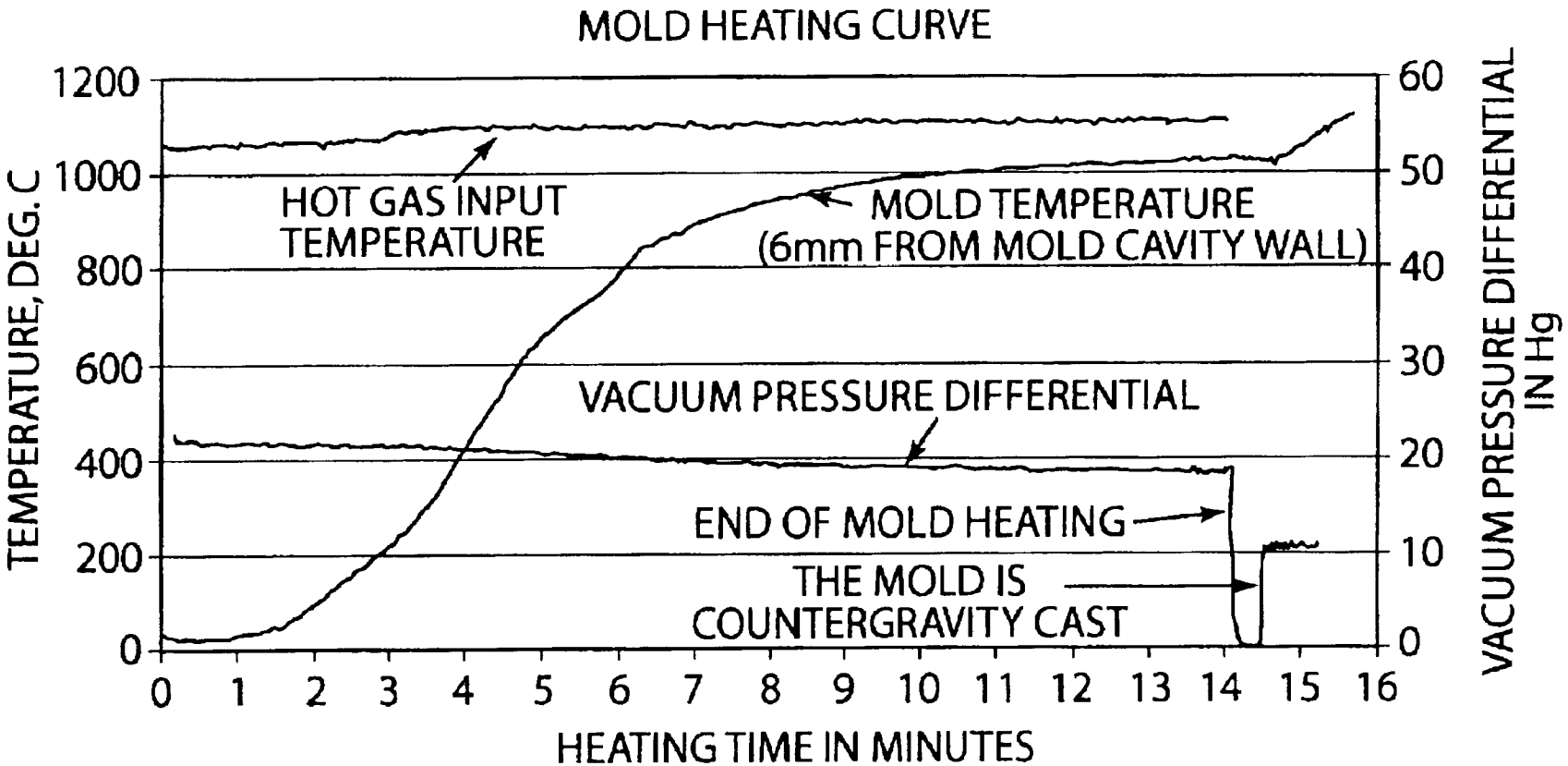
FIG. 3 is a graph of temperature of the hot gas and mold, and vacuum pressure differential versus time during countergravity casting pursuant to an embodiment of the invention.

After the pattern was eliminated, the mold cavities were heated to 1025° C. by the flow of the hot gas through the gas permeable refractory mold for a time of about 14 minutes, FIG. 3. The temperature curve of a thermocouple located about 6 mm from the mold cavity wall in the unbonded support media showed that the mold wall as well some distance into the un-bonded support media was heated during the flowing of the hot gas. A favorable temperature gradient was developed in the unbonded particulate support media, FIG. 2, which aided in the maintenance of the surface temperature of the mold cavities between when the hot gas flow is removed and the mold is cast. This is shown clearly in the mold temperature curve in FIG. 3, where the temperature of the mold did not change over the 30 seconds between when the vacuum and therefore the hot gas flow is stopped and when the mold was cast.

Figure 5:
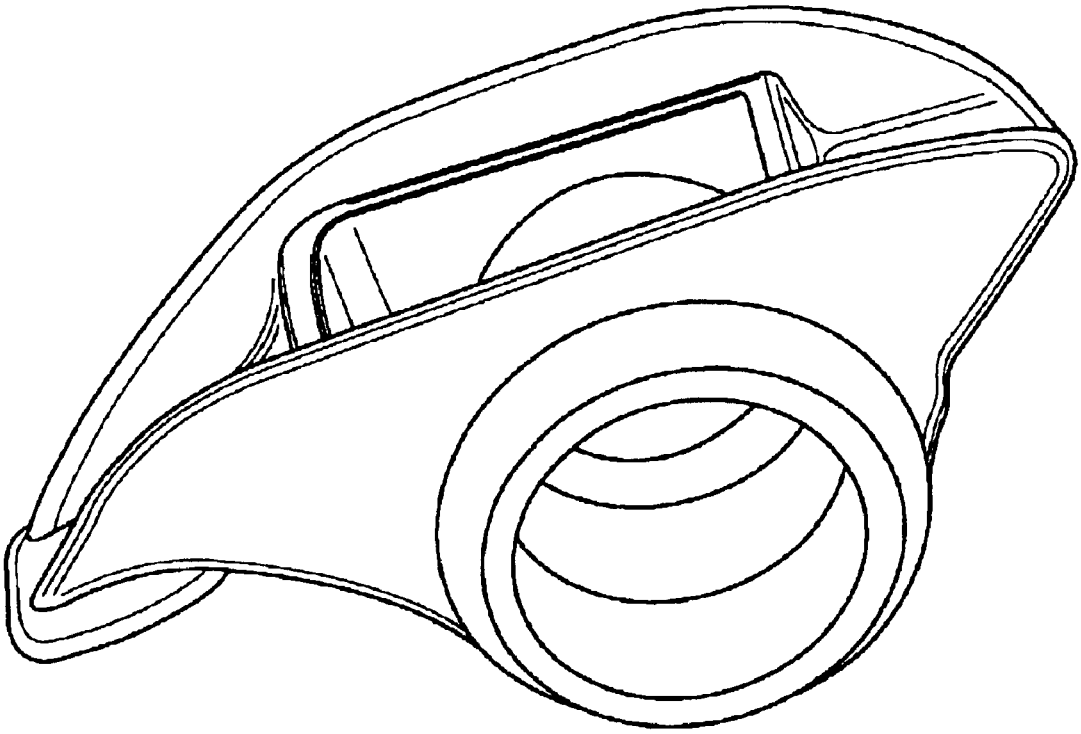
FIG. 5 is a perspective view of a cast steel rocker arm countergravity cast pursuant to another embodiment of the invention.

After the mold reached the desired preheat casting temperature, the flow of hot gas was discontinued, and molten steel was counter-gravity cast into the heated mold cavities by immersion of the refractory conduit 12 into the molten steel, FIG. 2, and reapplying vacuum to the casting chamber 20*a* of can 20. FIG. 5 illustrates one of the cast steel rocker arms.

The second Example 2 involves using an embodiment of the mold heating process of the invention to adjust the temperature of a previously heated shell mold after it was placed in support media 16.

A very thin bonded refractory shell mold about 9" diameter×28" tall containing 225 lever parts was made by the well known lost wax investment casting ceramic shell process. The mullite based refractory shell mold was made with a total of 4 shell layers that resulted in a bonded ceramic mold wall that was 2 to 3 mm in thickness. The refractory shell mold was steam autoclaved to remove most of the pattern wax. The mold was heated in an oven to 1900° F. to remove the pattern residue and to preheat the mold. The hot bonded refractory shell mold was then removed from the oven, connected to a refractory conduit 12 and placed in casting chamber 20*a* of can 20 with the conduit 12 extending through a hole in the bottom of the can. Mullite grain support media 16 was compacted around the shell mold. The support media was required to prevent mold failure during the casting of the mold.

Figure 4:
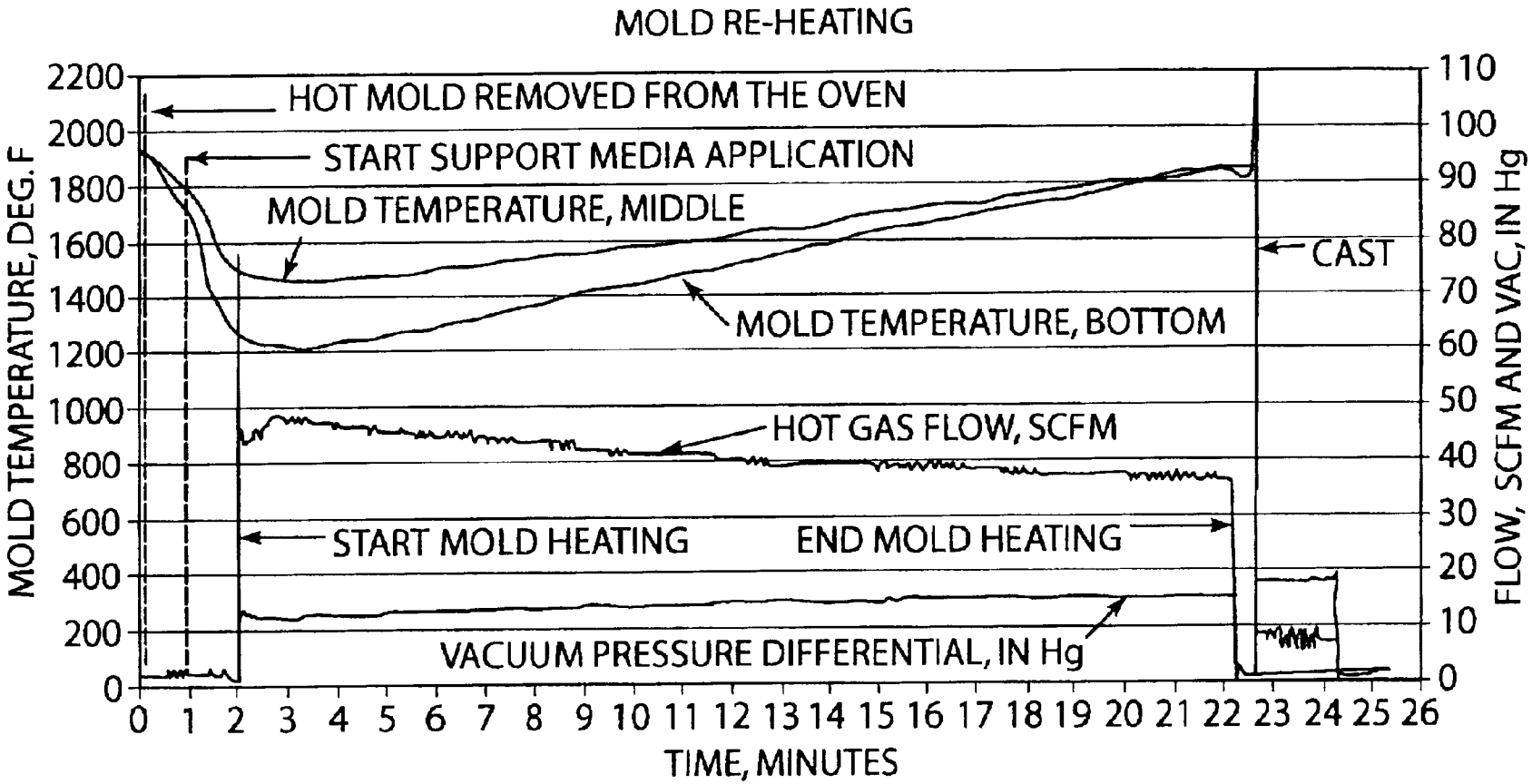
FIG. 4 is a graph of temperature of the mold, the gas flow rate, and vacuum pressure differential versus time during mold re-heating pursuant to another embodiment of the invention.

As shown in FIG. 4, the thin shell mold cooled off quickly following removal from the mold preheat oven and after surrounding with unbonded support media as measured by thermocouples located adjacent the bottom and the middle of the shell mold. The 400 to 700° F. temperature loss results in a lower mold temperature at the time of casting. Low mold temperatures can contribute to defects such as misruns, shrinkage, entrapped gas and hot tears, especially in thin castings.

The can 20 was moved to a small gas fired "Speedy Melt" furnace capable of producing 325,000 BTU/hour, and lowered to position the refractory conduit 12 into the hot gas stream discharged from the furnace. Vacuum at a level of about 20 in Hg was applied to the support media inside the casting chamber through the vacuum port 24 in the top cover 22*a*.

The mold cavities were heated to 1850° F. by the flow of the hot gas through the refractory conduit 12 and through the gas permeable mold wall for a time of about 20 minutes, see FIG. 4. A favorable temperature gradient was developed in the unbonded particulate support media, which aided in the maintenance of the temperature of the mold cavities between when the hot gas flow is removed and the mold is cast. This is shown clearly in the mold temperature curves in FIG. 4, where the temperature of the mold as measured by thermocouples at its bottom and middle did not change over the 30 seconds between when the vacuum and therefore the hot gas flow is stopped and when the mold was cast.

After the mold reached the desired pre-heat temperature, the flow of hot gas was discontinued, and molten steel was counter-gravity cast into the heated mold cavities by immersion of the refractory conduit into the molten steel, and reapplying the vacuum in the casting chamber.

Although the above embodiments demonstrate the use countergravity casting steel, the molds preheated pursuant to the invention can also be gravity or pressure cast by methods well known in the metal casting industry in any metal or alloy.

Moreover, although the above embodiments also demonstrate the use heating of thin bonded gas permeable refractory molds that are surrounded with compacted unbonded particulate support media to prevent the failure of the mold, this mold heating method can also be utilized without support media 16 about the mold 10 in the can 20 if the bonded refractory mold does not require it as mentioned above.

Those skilled in the art will appreciate that the invention is not limited to the embodiments described above and that changes and modifications can be made therein within the spirit of the invention as set forth in the appended claims.

What is claimed is:

1. A method of heating a gas permeable mold wall forming an empty mold cavity of a bonded refractory mold prior to casting a molten metallic material in said mold cavity, comprising flowing hot gas from a hot gas source through said mold cavity and through said mold wall to a region exterior of said mold before casting the molten metallic material into the mold cavity so as to establish a casting temperature at an interior surface of said mold wall and a temperature gradient between said interior surface and said region exterior of said mold that reduces loss of said casting temperature after the hot gas flow is stopped and before casting the molten metallic material into said mold cavity to reduce casting defects upon solidification of said molten metallic material in said mold cavity.

2. The method of claim 1 wherein said region is at a pressure less than a pressure in said mold cavity.

3. The method of claim 1 wherein said mold wall includes a gas permeability effective to establish a pressure drop across said mold wall from said mold cavity toward said region.

4. The method of claim 3 wherein said pressure drop across said mold wall results in a substantially uniform flow of the gas through all areas of the gas permeable refractory mold.

5. The method of claim 1 wherein said casting temperature and said temperature gradient are adjusted by controlling the temperature of the gas flow through the mold.

6. The method of claim 1 including preheating said mold to an elevated temperature by flowing said hot gas through said mold cavity and said mold wall and reducing said elevated temperature to a lower temperature by flowing cooling gas through said mold cavity and said mold wall.

7. The method of claim 1 including increasing hot gas flow through said mold cavity and said mold wall to accelerate the heating of the bonded refractory mold wall.

8. The method of claim 1 including establishing said temperature gradient to extend from said interior surface of said mold wall into a particulate support media surrounding said mold such that the loss of said casting temperature at said interior surface is reduced after the hot gas flow is stopped and before the molten metallic material is cast in said mold cavity.

9. The method of claim 8 wherein a distance into said particulate support media is preheated to a desired temperature before casting said molten metallic material into said mold cavity.

10. The method of claim 1 including preheating said mold to an elevated temperature in a heating chamber, moving said mold from said heating chamber to a casting chamber whereby said mold cools to a lower temperature, and reheating said mold to said elevated temperature by flowing said hot gas through said mold cavity and said mold wall.

11. A method of controlling temperature of a gas permeable mold wall forming a mold cavity of a bonded refractory mold prior to casting a molten metallic material in said mold cavity, comprising flowing hot gas from a hot gas source through said mold cavity and through said mold wall to a region exterior of said mold to preheat the mold to an elevated temperature and then reducing said elevated temperature to a lower temperature by flowing cooling gas through said mold cavity and said mold wall.

12. A method of controlling temperature of a gas permeable mold wall forming a mold cavity of a bonded refractory mold prior to casting a molten metallic material in said mold cavity, comprising preheating said mold to an elevated temperature by flowing hot gas through said mold cavity and then reducing said elevated temperature to a lower temperature by flowing cooling gas through said mold cavity and said mold wall.

13. A method of controlling temperature of a gas permeable mold wall forming a mold cavity of a bonded refractory mold surrounded exteriorly by a particulate support media prior to casting a molten metallic material in said mold cavity, comprising flowing hot gas from a hot gas source through said mold cavity and through said mold wall into said support media to establish a casting temperature at an interior surface of said mold wall and a temperature gradient between said interior surface and said support media exterior of said mold that reduces loss of said casting temperature after the hot gas flow is stopped and before casting a molten metallic material into said mold cavity.

14. The method of claim 13 wherein a distance into said particulate support media is heated to a desired temperature before casting said molten metallic material into said mold cavity.

15. A method of controlling temperature of a gas permeable mold wall forming a mold cavity of a bonded refractory mold prior to casting a molten metallic material in said mold cavity, comprising preheating said mold to an elevated temperature in a heating chamber, moving said mold from said heating chamber to a casting chamber whereby said mold cools to a lower temperature, and reheating said mold to a casting temperature by flowing hot gas from a hot gas source through said mold cavity and through said mold wall.

* * * * *